US005849212A

United States Patent [19]

Shima et al.

[11] Patent Number: 5,849,212

[45] Date of Patent: Dec. 15, 1998

[54] ELECTROVISCOUS FLUID CONTAINING β-ALUMINA

[75] Inventors: Koji Shima, Yokohama; Eiji Hattori, Machida; Yasuo Oguri, Tokyo, all of Japan

[73] Assignee: Mitsubishi Chemical Corporation, Tokyo, Japan

[21] Appl. No.: 461,753

[22] Filed: Jun. 5, 1995

Related U.S. Application Data

[63] Continuation of Ser. No. 266,093, Jun. 27, 1994, abandoned, which is a continuation of Ser. No. 115,700, Sep. 3, 1993, abandoned, which is a continuation of Ser. No. 790,086, Nov. 13, 1991, abandoned, which is a continuation of Ser. No. 491,821, Mar. 12, 1990, abandoned.

[30] Foreign Application Priority Data

Mar. 14, 1989 [JP] Japan ..... 1-61454

[51] Int. Cl.[6] ..... C10M 171/00; C10M 169/04

[52] U.S. Cl. ..... 252/74; 252/572

[58] Field of Search ..... 252/74, 75, 76, 252/572

[56] References Cited

U.S. PATENT DOCUMENTS

| | | | |
|---|---|---|---|
| 3,047,507 | 7/1962 | Winslow | 252/75 |
| 3,367,872 | 2/1968 | Martinek et al. | 252/74 |
| 3,970,573 | 7/1976 | Westhaver | 252/74 |
| 4,376,060 | 3/1983 | Stadler | 252/25 |
| 4,687,589 | 8/1987 | Block et al. | 252/73 |
| 4,744,914 | 5/1988 | Filisko et al. | 252/572 |
| 4,772,407 | 9/1988 | Carlson | 252/74 |
| 5,149,454 | 9/1992 | Bloink et al. | 252/74 |
| 5,279,753 | 1/1994 | Blonik et al. | 252/572 |

FOREIGN PATENT DOCUMENTS

| | | |
|---|---|---|
| 0 361 106 | 4/1990 | European Pat. Off. . |
| 1570234 | 6/1980 | United Kingdom . |

OTHER PUBLICATIONS

Matsepuro, "Structure Formation in an Electric Field and the Composition of Electrorheological Suspensions", translated from Elektroeol. Issled Pril, Minsk, pp. 27–51, 1981 no month available.

Block et al, "Electro–rheology", J. Phys. D:Appl. Phys, 21(12), pp. 1661–1677, 1988 no month available.

Hong, "Crystal Structures and Crystal Chemistry in the System $Na_{1+x}Zr_2Si_xP_{3-x}O_2$", Mat. Res. Bull. vol. 11, pp. 173–182, 1976 no month available.

*Primary Examiner*—Christine Skane

*Attorney, Agent, or Firm*—Oblon, Spivak, McClelland, Maier & Neustadt, P.C.

[57] ABSTRACT

An electroviscous fluid comprising an electrically insulated liquid and solid ectrolyte particles dispersed therein.

4 Claims, 1 Drawing Sheet

ELECTROVISCOUS FLUID CONTAINING β-ALUMINA

This application is a Continuation of application Ser. No. 08/266,093, filed on Jun. 27, 1994, which is a Continuation of application Ser. No. 08/115,700, filed on Sep. 3, 1993 now abandoned, which is a continuation of application Ser. No. 07/790,086, filed on Nov. 13, 1991 now abandoned, which is a continuation of application Ser. No. 07/491,821, filed on Mar. 12, 1990, now all abandoned.

BACKGROUND OF THE INVENTION

1. Field of the Invention

The present invention relates to an electroviscous fluid. The electroviscous fluid is a fluid showing an electric viscosity effect such that upon application of an electric field, the apparent viscosity changes quickly and reversibly.

2. Discussion of the Background

Heretofore, as one of electroviscous fluids, a fluid is known which is composed of a fluid system comprising a continuous phase of an electrically insulating liquid, a dispersed phase of fine particles containing or having adsorbed ions and a small amount of water. This water is adsorbed by the fine particles to form ions in the particles, and when an electric field is applied, the ions will move in the particles and will be maldistributed so that the particles will be polarized, whereby the electroviscous effect is believed to be generated by the cohesive force of the particles due to the electrostatic attraction. Further, with such an electroviscous fluid, it is known that the electroviscousity effect and the electric power consumption vary depending upon the amount of water.

However, such water contained in the conventional electroviscous fluid restricts the practical application of the electroviscous fluid. For example, at high temperature or in an environment where a high shearing stress is exerted to generate heat, the water tends to be evaporated, whereby no adequate electroviscous effect will be shown. Further, there has been a problem that due to the presence of the water, the apparatus is likely to be corroded, and the power consumption tends to increase.

SUMMARY OF THE INVENTION

It is an object of the present invention to provide an electroviscous fluid improved to overcome the above problems. This object can readily be accomplished by dispersing solid electrolyte particles in an electrically insulating liquid.

Thus, the present invention provides an electroviscous fluid comprising an electrically insulating liquid and solid electrolyte particles dispersed therein.

BRIEF DESCRIPTION OF THE DRAWINGS

In the accompanying drawing.

DETAILED DESCRIPTION OF THE PREFERRED EMBODIMENTS

Figure 1:
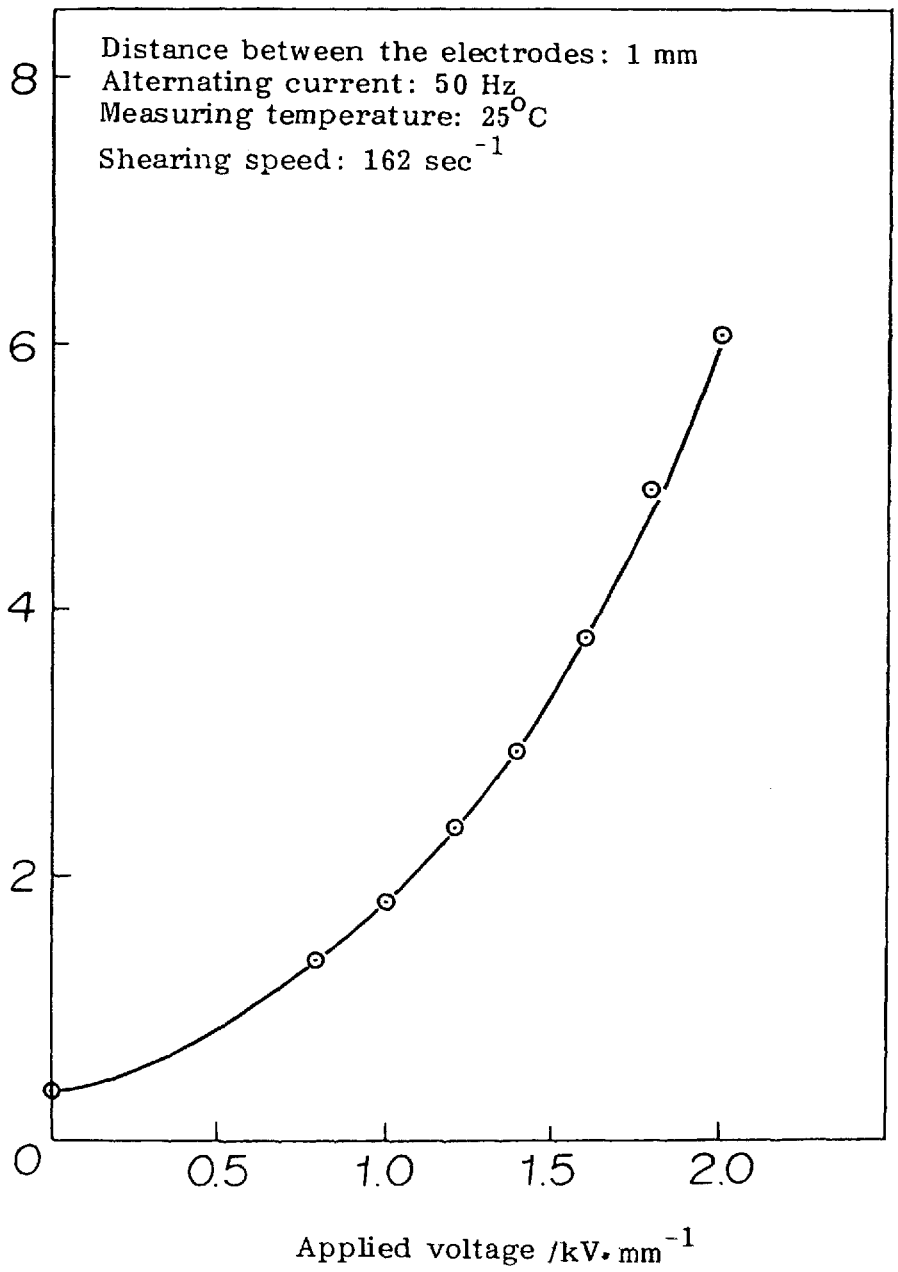
FIG. 1 is a graph showing the viscosity-increasing effect of the electroviscous fluid of the present invention to an applied electric field, wherein the abscissa indicates the applied voltage ($kV \cdot mm^{-1}$), and the ordinate indicates the viscosity (Poise).

Now, the present invention will be described in detail with reference to the preferred embodiments.

The electroviscous fluid of the present invention is prepared by dispersing solid electrolyte particles in an electrically insulating liquid.

The solid electrolyte is a substance having a high ionic conductivity at a level equal to an electrolyte solution or melted salt, in a solid state within a temperature range substantially lower than the melting point and is referred to also as a solid ionics, a super ionic conductor or a high speed ionic conductor. It is available not only in a crystal form but also in an amorphous form or a polymer form. Specifically, various solid electrolytes as disclosed in "Solid Ionics" coauthored by Tetsuichi Kudo and Kazuo Fueki, published by Kodansha or in "Ceramic Materials for Electronics" edited by Relva C. Buchanan, Marcel Dekker, Inc, New York, Basel, may be used, as far as the electric conductivity generated by the mobility of ions at the temperature of said electroviscous fluid in use is around $10^{-1}$ to $10^{-8}$ S/cm, preferably around $10^{-2}$ to $10^{-7}$ S/cm, depending upon the electroviscous effect required.

Typical examples include inorganic solid electrolytes such as β-alumina, NASICON ($Na_3Zr_2PSi_2O_{12}$), AgI, $Li_3N$, lithium aluminum silicate such as $LiAlSiO_4$, lithium borate such as $Li_2B_4O_7$, lithium niobate such as $Li_2Nb_2O_6$, silver-germanium sulfide such as $5OAg_2S$-5GeS-45$GeS_2$ and polymer solid electrolytes such as alkali metallic salt-polyethylene oxide complexes (ex. NaSCN-PEO, KSCN-PEO, CsSCN-PEO, $LiBF_4$-PEO), alkali halide-crown ether complexes.

The component elements of the above inorganic solid electrolytes may be partly replaced with another elements, as far as the electric conductivity of said solid eletrolytes is in the above described condition.

The electrically insulating material can exist in the particles in the amount that doesn't inhibit the electric conductivity of the particle as a whole. Such a solid electrolyte is used in the form of fine particles. The particle size of the fine particles is not particularly limited so long has the fine particles can be dispersed in a stabilized condition in the dispersion medium which will be described hereinafter. However, it is preferred to employ particles having an average particle size of from 0.05 to 500 μm, more preferably from 0.5 to 50 μm. Such solid electrolyte particles contain mobile ions derived from the structures, and contain no volatile component such as water. Therefore, an electroviscous fluid prepared by using such solid electrolyte particles, is capable of providing a thermally stable electroviscous effect.

Next, the electrically insulating liquid suitable for use as a dispersion medium is preferably the one which is capable of dispersing the above mentioned particles under a stabilized condition and which has a high electric resistivity, such as silicone oil, trance oil, engine oil, an ester or a dihydric alcohol.

The amount of the solid electrolyte particles to the dispersion medium is usually from 5 to 50% by volume, preferably from 10 to 40% by volume. For the dispersion, a usual mixing and dispersing machine represented by a ball mill or a supersonic disperser, may be employed.

The method for measuring the electroviscous effect was such that by using a rotating coaxial double cylinder viscometer, the increase in the shearing stress upon application of a voltage between the inner and outer cylinders, was obtained under the same shearing speed (162 $sec^{-1}$), and it was converted to the change in the viscosity.

The fluidity of the electroviscous fluid can be controlled by the voltage to be applied. Therefore, its development in the mechatronics field of computer control is expected in future. Specific examples for its application may be mentioned. In the automobile industry, it may be applied to such parts as clutches, torque convertors, valves, shock absorbers, brake systems or power steerings. Further, in the field of industrial robots, it is being applied to various actuators.

Now, the present invention will be described in further detail with reference to Examples. However, it should be understood that the present invention is by no means restricted to such specific Examples.

EXAMPLE 1

β-alumina (manufactured by Kojundo Kagaku Kenkyujo) was pulverized in a mortar to obtain particles having an average particle size of 11 μm, which were then dried at 2500° C. for 48 hours to thoroughly remove water. Then, 11.24 g of the particles were added to 13.08 g of silicone oil (Toray Silicone SH 200, 10 cs), and the mixture was dispersed and mixed for 12 hours by a ball mill.

With respect to the electroviscous fluid of the present invention thus obtained, by using a rotating coaxial double cylinder viscometer, the shearing stress upon application of a voltage between the inner and outer cylinders was measured at the same shearing speed (162 $sec^{-1}$) (the distance between the electrodes: 1 mm). The results thereby obtained are shown in FIG. 1. This electroviscous fluid had a viscosity (initial viscosity) of 0.2 poise when no electric field was applied at 25° C., and the viscosity increased to 6 poise when an electric field with an intensity of 2 $kV \cdot mm^{-1}$ was applied. Even after being heated at 120° C. for 12 hours, it showed exactly the same viscosity, and no change was observed in the properties. Further, this electroviscous fluid was heated, and the viscosity at 62° C. was measured, whereby the initial viscosity was 0.1 poise, and the viscosity increased to 3 poise upon application of an electric field with an intensity of 2 $kV \cdot mm^{-1}$.

COMPARATIVE EXAMPLE 1

Silicagel particles having an average particle size of 0.9 μm were dried at 250° C. for 16 hours to thoroughly remove water. Then, to 10.00 g of the particles, 1.24 g of an aqueous sodium hydroxide solution having a concentration of 13.1 mol/l was added, and the mixture was added to 18.68 g of silicone oil and dispersed and mixed for 12 hours by a ball mill.

This electroviscous fluid had an initial viscosity of 0.5 poise at 25°C., and the viscosity increased to 16 poise when an electric field with an intensity of 2 $kV \cdot mm^{-1}$ was applied. However, after it was heated at 120° C. for two hours, its viscosity decreased to 7 poise upon application of the same electric field. After being heated at 120° C. for 12 hours, it showed no viscosity change even when an electric field was applied.

As described in the foregoing, the present invention provides an electroviscous fluid which exhibits a constant electroviscous effect within a wide temperature range as compared with the compositions disclosed in the prior art.

We claim:

1. An electroviscous fluid, consisting essentially of an electrically insulating liquid and 5–50% by volume of solid electrolyte particles consisting of β-alumina dispersed therein, wherein said solid electrolyte particles show electric conductivity of $10^{-1}$ to $10^{-8}$ S/cm at the temperature of said electroviscous fluid use, and wherein said electric conductivity is not dependent upon the presence of water in said solid electrolyte particles.

2. The electroviscous fluid of claim 1, wherein said solid electrolyte particles have an average particle size of from 0.05 to 500 microns.

3. The electroviscous fluid of claim 1, wherein said electrically insulating liquid is silicone oil, an ester or dihydric alcohol.

4. The electroviscous fluid of claim 1, wherein said electrically insulating liquid is 13.08 grams of silicone oil and said β-alumina is 11.24 grams of β-alumina having an average particle size of 11 microns.

* * * * *